US006743750B2

(12) United States Patent
Nagase et al.

(10) Patent No.: US 6,743,750 B2
(45) Date of Patent: Jun. 1, 2004

(54) HEAT-SENSITIVE RECORDING MATERIAL

(75) Inventors: Hisato Nagase, Shizuoka-ken (JP); Yoshihiro Jimbo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 78 days.

(21) Appl. No.: 09/987,082

(22) Filed: Nov. 13, 2001

(65) Prior Publication Data

US 2002/0086797 A1 Jul. 4, 2002

(30) Foreign Application Priority Data

Nov. 13, 2000 (JP) ..... 2000-345694

(51) Int. Cl.[7] ..... B41M 5/20
(52) U.S. Cl. ..... 503/201; 503/215; 503/217
(58) Field of Search ..... 503/201, 215, 503/217, 218

(56) References Cited

FOREIGN PATENT DOCUMENTS

JP 60-89391 5/1985

*Primary Examiner*—Bruce H. Hess
(74) *Attorney, Agent, or Firm*—Sughrue Mion, PLLC

(57) ABSTRACT

A heat-sensitive recording material includes, on a support thereof, a heat-sensitive recording layer containing a diazo compound and a coupler. The diazo compound is encapsulated in microcapsules and is represented by the following general formula (1):

General formula (1)

20 Claims, No Drawings

HEAT-SENSITIVE RECORDING MATERIAL

BACKGROUND OF THE INVENTION

1. Field of the Invention

The present invention relates to a heat-sensitive recording material using a diazo compound and a coupler as color-forming components, and more particularly, to a heat-sensitive recording material which is excellent in photo-fixing property when a light source emitting light having a wavelength longer than 400 nm is used, and which has low color formation in background areas.

2. Description of the Related Art

In general, diazo compounds have very high chemical activity. Diazo compounds react with a compound (so-called coupler) having an active methylene group or a phenol derivative, and readily form azo dyes. Also, diazo compounds are photosensitive and are decomposed when exposed to light, thereby losing their chemical activity. For these reasons, diazo compounds have been used for a long time as photo-recording materials such as for diazo copies (see "Fundamentals of Photographic Engineering: Non-Silver Salt Photography Edition", published by Corona Co., Ltd., pp. 89–117 and pp. 182–201 (1982)).

Further, by utilizing the property of diazo compounds whereby their chemical activity is lost by being decomposed by light, diazo compounds have recently been applied to recording materials which require image fixation. As a typical example, a photo-fixing type heat-sensitive recording material has been proposed wherein a diazo compound and a coupler are reacted by heating in accordance with image signals to form an image, and then exposed to light to fix the image (see Koji Sato, et al., Journal of The Institute of Image Electronic Engineers of Japan, Vol. 11, No. 4, pp. 290–296 (1982), etc.).

These recording materials using a diazo compound as a color forming component are generally exposed to an ultra violet ray having a wavelength of about 360 nm in a fixing process in order to effectively performing photo-fixing. However, the ultra violet ray requires a special light source, and there are problems in that it may have a harmful effect on eyes, and the like. Therefore, there has been a need for a recording material using a diazo compound with which fixing can be effectively performed when a light source which emits visible light having a wavelength longer than 400 nm is used.

However, there has been a problem with a conventional recording material using a diazo compound in that fixation proceeds slowly and therefore a long time is required in order to deactivate the diazo compound with a light source emitting light having a wavelength longer than 400 nm. Another problem has been that, if photo-fixing is carried out for a long time in order to complete the fixing, a product generated by the photo-fixing also reacts and this may result in a color-formed image having low whiteness in background areas.

SUMMARY OF THE INVENTION

An object of the present invention is to provide a heat-sensitive recording material which is excellent in photo-fixing property when a light source emitting light having a wavelength longer than 400 nm is used, and has which low color-formation in background areas.

The object of the present invention can be accomplished by the following means.

First aspect of the present invention is a heat-sensitive recording material comprising a support and at least one heat-sensitive recording layer. The heat-sensitive recording layer comprises at least one diazo compound and at least one coupler, and the at least one diazo compound is encapsulated in microcapsules and is represented by the following general formula (1):

General formula (1)

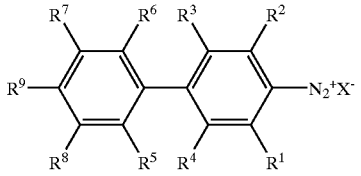

wherein $R^1$, $R^2$, $R^3$, $R^4$, $R^5$, $R^6$, $R^7$ and $R^8$ each independently represents a hydrogen atom, a halogen, an alkyl group, an alkoxy group, an alkylthio group or an arylthio group; $R^9$ represents a hydrogen atom, an alkyl group or an alkoxy group; and $X^-$ represents an anion.

Second aspect of the present invention is a heat-sensitive recording material comprising a support and at least one heat-sensitive recording layer. The heat-sensitive recording layer comprises at least one diazo compound and at least one coupler, and the at least one diazo compound is encapsulated in microcapsules and is represented by the following general formula (2):

General formula (2)

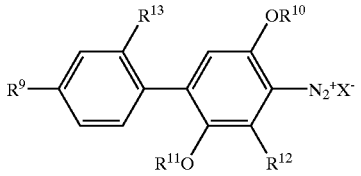

wherein $R^9$ represents a hydrogen atom, an alkyl group or an alkoxy group; $R^{10}$ and $R^{11}$ each independently represents an alkyl group; $R^{12}$ and $R^{13}$ each independently represents a hydrogen atom, a halogen, an alkyl group or an alkoxy group; and $X^-$ represents an anion.

Third aspect of the present invention is a heat-sensitive recording method. The method comprises the steps of:

preparing a heat-sensitive recording material comprising a support and at least one heat-sensitive recording layer, the heat-sensitive recording layer comprising at least one diazo compound and at least one coupler, the at least one diazo compound being encapsulated in microcapsules and being represented by the following general formula (1):

General formula (1)

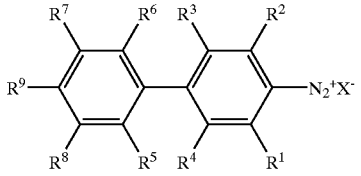

wherein $R^1$, $R^2$, $R^3$, $R^4$, $R^5$, $R^6$, $R^7$ and $R^8$ each independently represent a hydrogen atom, a halogen, an alkyl group, an alkoxy group, an alkylthio group or an arylthio group; $R^9$ represents a hydrogen atom, an alkyl group or an alkoxy group; and $X^-$ represents an anion;

heating a recording surface of the heat-sensitive recording material imagewise to cause a reaction between the diazo compound and the coupler to form a color; and irradiating light to decompose the remaining diazo compound which has not formed a color.

DESCRIPTION OF THE PREFERRED EMBODIMENTS

<<Heat-Sensitive Recording Material>>

A heat-sensitive recording material of the present invention comprises a heat-sensitive recording layer containing a diazo compound and a coupler on a support thereof, wherein the diazo compound is encapsulated in microcapsules, and is represented by the following general formula (1):

General Formula (1)

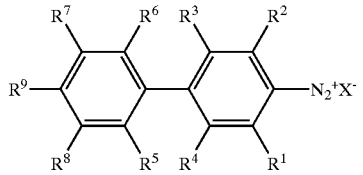

wherein $R^1$, $R^2$, $R^3$, $R^4$, $R^5$, $R^6$, $R^7$ and $R^8$ each independently represent a hydrogen atom, a halogen, an alkyl group, an alkoxy group, an alkylthio group or an arylthio group, and $R^9$ represents a hydrogen atom, an alkyl group or an alkoxy group. $X^-$ represents an anion.

By including the compound represented by general formula (1) in the heat-sensitive recording layer of the heat-sensitive recording material of the present invention in a state in which it is encapsulated in the microcapsules, a heat-sensitive recording material which is excellent in photo-fixing property when a light source emitting light having a wavelength longer than 400 nm is used, and which has low color formation in background areas can be provided.

<Heat-Sensitive Recording Layer>

[Diazo Compound]

The diazo compound according to the present invention is characterized in that it is represented by the above-described general formula (1). Since the diazo compound according to the present invention is highly soluble in an organic solvent, a uniform emulsified dispersion can easily be obtained. Further, since the diazo compound exhibits an excellent photo-decomposition rate when exposed to light having a wavelength longer than 400 nm, photo-fixing property can be significantly improved.

In general formula (1), $R^1$, $R^2$, $R^3$, $R^4$, $R^5$, $R^6$, $R^7$ and $R^8$ each independently represents a hydrogen atom, a halogen, an alkyl group, an alkoxy group, an alkylthio group or an arylthio group. As the halogen represented by the above $R^1$, $R^2$, $R^3$, $R^4$, $R^5$, $R^6$, $R^7$ and $R^8$, a chlorine atom or a bromine atom is preferable.

The alkyl group represented by the above $R^1$, $R^2$, $R^3$, $R^4$, $R^5$, $R^6$, $R^7$ and $R^8$ preferably has 1 to 30 carbon atoms, and more preferably has 1 to 12 carbon atoms. The alkyl group may have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic acid group, and a heterocyclic group.

Particularly preferable examples of the alkyl group represented by the above $R^1$, $R^2$, $R^3$, $R^4$, $R^5$, $R^6$, $R^7$ and $R^8$ include a methyl group, an ethyl group, a butyl group, a hexyl group, a heptyl group, an octyl group, a 2-ethylhexyl group, a decyl group, a dodecyl group, an octadecyl group, a 2-hydroxyethyl group, a 2-benzoyloxyethyl group, a 2-(4-butoxyphenoxy)ethyl group and a benzyl group. Among them, a methyl group, an ethyl group, a butyl group, a heptyl group, an octyl group, a 2-ethylhexyl group, and a dodecyl group are more preferable, and a methyl group, an ethyl group, a butyl group and a 2-ethylhexyl group are most preferable.

The alkoxy group represented by the above $R^1$, $R^2$, $R^3$, $R^4$, $R^5$, $R^6$, $R^7$ and $R^8$ preferably has 1 to 30 carbon atoms, and more preferably has 1 to 12 carbon atoms. The alkoxy group may have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic group, and a heterocyclic group.

Particularly preferable examples of the alkoxy group represented by the above $R^1$, $R^2$, $R^3$, $R^4$, $R^5$, $R^6$, $R^7$ and $R^8$ include a methoxy group, an ethoxy group, a butoxy group, a hexyloxy group, a heptyloxy group, an octyloxy group, a decyloxy group, a dodecyloxy group, a cyclohexyloxy group, an octadecyloxy group, a 2-ethoxyethoxy group, a 2-chloroethoxy group, a 2-phenoxyethoxy group, a 2-(2-butoxyphenoxy)ethyl group and a benzyloxy group. Among them, a methoxy group, an ethoxy group, a butoxy group, a hexyloxy group, a heptyloxy group, an octyloxy group, a decyloxy group and a dodecyloxy group are more preferable, and a methoxy group, a butoxy group, heptyloxy group, an octyloxy group and a decyloxy group are most preferable.

The alkylthio group represented by the above $R^1$, $R^2$, $R^3$, $R^4$, $R^5$, $R^6$, $R^7$ and $R^8$ preferably has 1 to 30 carbon atoms, and more preferably has 1 to 12 carbon atoms. The arylthio group represented by the above $R^1$, $R^2$, $R^3$, $R^4$, $R^5$, $R^6$, $R_7$ and $R^8$ preferably has 6 to 30 carbon atoms, and more preferably has 6 to 12 carbon atoms. The alkylthio group and the arylthio group may respectively have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic group, and a heterocyclic group.

Particularly preferable examples of the alkylthio group represented by the above $R^1$, $R^2$, $R^3$, $R^4$, $R^5$, $R^6$, $R^7$ and $R^8$ include a methylthio group, an ethylthio group, a butylthio group, cyclohexylthio group, an octylthio group, a 2-ethylhexylthio group, a dodecylthio group, a 2-(N,N-dioctylcarbamoyl)ethylthio group, an allylthio group and a 2-hydroxyethylthio group. Among them, a cyclohexylthio group, an octylthio group and a dodecylthio group are more preferable, and an octylthio group and a dodecylthio group are most preferable.

Particularly preferable examples of the arylthio group represented by the above $R^1$, $R^2$, $R^3$, $R^4$, $R^5$, $R^6$, $R^7$ and $R^8$ include a benzylthio group, a phenylthio group, a 2-butoxycarbonylphenylthio group, a 2-chlorophenylthio group, a 4-chlorophenylthio group and a 4-methylphenylthio group. Among them, a benzylthio group, a phenylthio group, a 2-butoxycarbonylphenylthio group and a 4-methylphenylthio group are more preferable, and phenylthio group and a 4-methylphenylthio group are most preferable.

In general formula (1), $R^9$ represents a hydrogen atom, an alkyl group or an alkoxy group. The alkyl group represented by $R^9$ preferably has 1 to 30 carbon atoms, more preferably has 1 to 12 carbon atoms. The alkyl group may have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic group, and a heterocyclic group.

Particularly preferable examples of the alkyl group represented by $R^9$ include a methyl group, an ethyl group, a butyl group, a heptyl group, an octyl group, a 2-ethylhexyl group, a decyl group, a dodecyl group, an octadecyl group, a 2-hydroxyethyl group, a 2-benzoyloxyethyl group, a 2-(2-butoxyphenoxy) ethyl group and a benzyl group. Among them, a methyl group, an ethyl group, a butyl group, a heptyl group, an octyl group, a 2-ethylhexyl group and a dodecyl group are more preferable, and a methyl group, an ethyl group, a butyl group and a 2-ethylhexyl group are most preferable.

The alkoxy group represented by $R^9$ preferably has 1 to 30 carbon atoms, more preferably has 1 to 12 carbon atoms. The alkoxy group may have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic group, and a heterocyclic group.

Particularly preferable examples of the alkoxy group represented by $R^9$ include a methoxy group, an ethoxy group, a butoxy group, a hexyloxy group, a heptyloxy group, an octyloxy group, a decyloxy group, a dodecyloxy group, a cyclohexyloxy group, an octadecyloxy group, a 2-ethoxyethoxy group, a 2-chloroethoxy group, a 2-phenoxyethoxy group and a benzyloxy group. Among them, a methoxy group, an ethoxy group, a butoxy group, a hexyloxy group, a heptyloxy group, an octyloxy group, a decyloxy group and a dodecyloxy group are more preferable, and a methoxy group, a butoxy group, a heptyloxy group, an octyloxy group and a decyloxy group are most preferable.

In general formula (1), $X^-$ represents an anion. The anion may be an inorganic anion or an organic anion. Preferable examples of the inorganic anion include a hexafluorophosphoric ion ($PF_6^-$), a borofluoride ion ($BF_4^-$), a chloride ion and a sulfuric ion. Among them, a hexafluorophosphoric ion ($PF_6^-$) and a borofluoride ion ($BF_4^-$) are more preferable. Preferable examples of the organic anion include a polyfluoroalkylcarboxylic acid ion, a polyfluoroalkylsulfonic acid ion, tetraphenylboric acid ion, an aromatic carboxylic acid ion, an aromatic sulfonic acid ion, and the like.

Each of $R^3$, $R^5$ and $R^8$ is preferably a hydrogen atom. Each of $R^1$ and $R^6$ is preferably a halogen, an alkyl group or an alkoxy group, more preferably an alkyl group or an alkoxy group. Each of $R^2$ and $R^4$ is preferably an alkoxy group.

The novel diazo compound according to the present invention is more preferably a diazo compound represented by the following general formula (2):

General Formula (2)

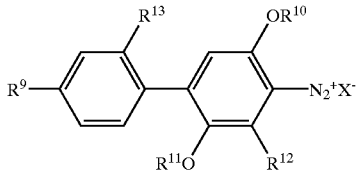

wherein $R^9$ represents a hydrogen atom, an alkyl group or an alkoxy group, and $R^{10}$ and $R^{11}$ each independently represents an alkyl group. $R^{12}$ and $R^{13}$ each independently represents a hydrogen atom, a halogen, an alkyl group or an alkoxy group. $X^-$ represents an anion.

In general formula (2), the definition of $R^9$ is the same as that of $R^9$ in general formula (1), and preferable examples thereof are also the same as those of $R^9$ in general formula (1).

In general formula (2), $R^{10}$ and $R^{11}$ each independently represents an alkyl group. The alkyl group represented by $R^{10}$ and $R^{11}$ preferably has 1 to 30 carbon atoms, and more preferably has 1 to 12 carbon atoms. The alkyl group may have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic group, and a heterocyclic group.

Particularly preferable examples of the alkyl group represented by $R^{10}$ and $R^{11}$ include a methyl group, an ethyl group, a butyl group, a hexyl group, a heptyl group, an octyl group, a 2-ethylhexyl group, a decyl group, a dodecyl group, an octadecyl group, a 2-hydroxyethyl group, a 2-benzoyloxyethyl group, a 2-(4-butoxyphenoxy)ethyl group and a benzyl group. Among them, a methyl group, an ethyl group, a butyl group, a hexyl group, a heptyl group, an octyl group, a decyl group and a dodecyl group are more preferable, and a methyl group, a butyl group, a heptyl group, an octyl group and a decyl group are most preferable.

In general formula (2), $R^{12}$ and $R^{13}$ each independently represent a hydrogen atom, a halogen, an alkyl group or an alkoxy group. The halogen represented by $R^{12}$ and $R^{13}$ is preferably a chlorine atom or a bromine atom.

The alkyl group represented by $R^{12}$ and $R^{13}$ preferably has 1 to 30 carbon atoms, more preferably has 1 to 12 carbon atoms. The alkyl group may have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic group, and a heterocyclic group.

Particularly preferable examples of the alkyl group represented by $R^{12}$ and $R^{13}$ include a methyl group, an ethyl group, a butyl group, an octyl group, a 2-ethylhexyl group, a decyl group, a dodecyl group, an octadecyl group, a 2-hydroxyethyl group, a 2-benzoyloxyethyl group, a 2-(4-butoxyphenoxy)ethyl group and a benzyl group. Among them, a methyl group, an ethyl group, a butyl group and an octyl group are more preferable, and a methyl group and an ethyl group are most preferable.

The alkoxy group represented by $R^{12}$ and $R^{13}$ preferably has 1 to 30 carbon atoms, more preferably has 1 to 12 carbon atoms. The alkoxy group may have at least one substituent, and preferable examples of the substituent include a phenyl group, a halogen, an alkoxy group, an aryloxy group, an alkoxycarbonyl group, an acyloxy group, an acylamino group, a carbamoyl group, a cyano group, a carboxylic acid group, a sulfonic group, and a heterocyclic group.

Particularly preferable examples of the alkoxy group represented by $R^{12}$ and $R^{13}$ include a methoxy group, an ethoxy group, a butoxy group, a hexyloxy group, a heptyloxy group, an octyloxy group, a dodecyloxy group, a cyclohexyloxy group, an octadecyloxy group, a 2-ethoxyethoxy group, a 2-chloroethoxy group, a 2-phenoxyethoxy group and a benzyloxy group. Among them, a methoxy group, an ethoxy group, a butoxy group, an octyloxy group, and a dodecyloxy group are more preferable, and a methoxy group, an ethoxy group, a butoxy group and an octyloxy group are most preferable.

In general formula (2), the definition of $X^-$ is the same as that of $X^-$ in general formula (1), and preferable examples thereof are also the same as those of $X^-$ in general formula (1).

Further, in the diazo compounds represented by general formulae (1) and (2), $R^1$, $R^2$, $R^3$, $R^4$, $R^5$, $R^6$, $R^7$, $R^8$, $R^9$, $R^{10}$, $R^{11}$, $R^{12}$ and $R^{13}$ may respectively have a diazoniophenyl group as a substituent, and the compounds may form a bis-form compound or a higher-form compound.

As specific examples of the diazo compound represented by general formula (1) or (2) of the present invention, exemplary compounds (A-1) to (A-30) are shown below, however, they are not intended to limit the present invention.

A-1

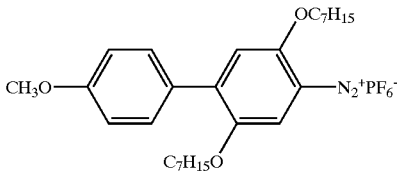

A-2

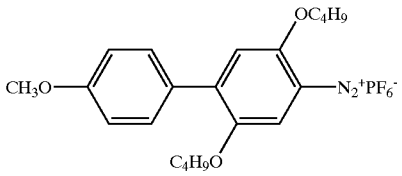

A-3

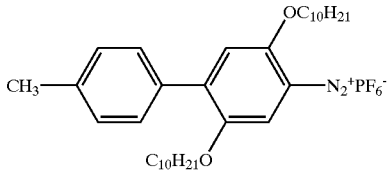

A-4

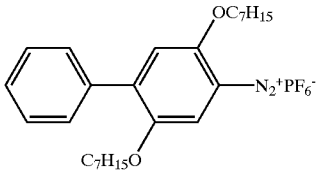

A-5

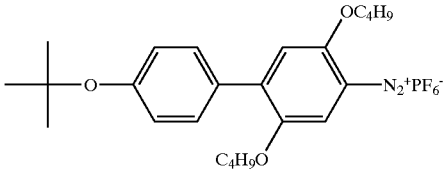

-continued

A-6

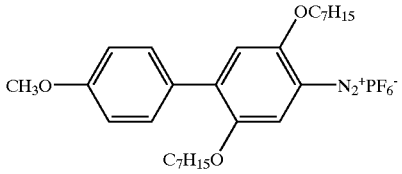

A-7

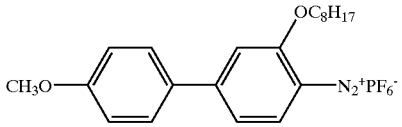

A-8

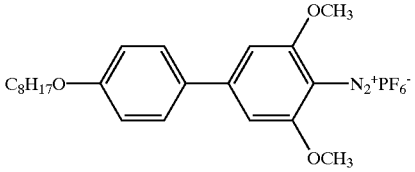

A-9

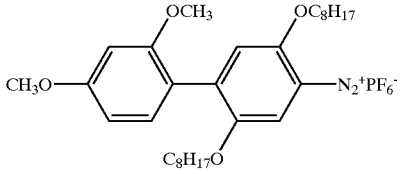

A-10

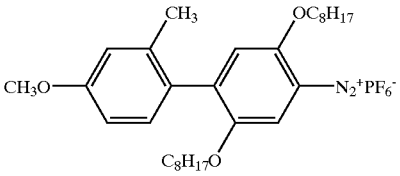

A-11

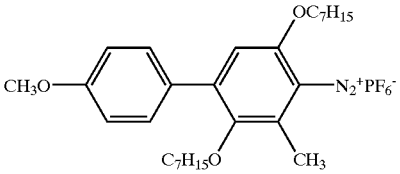

A-12

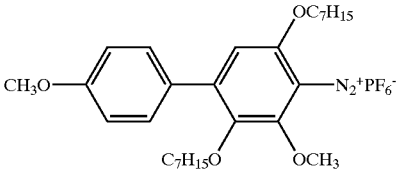

A-13

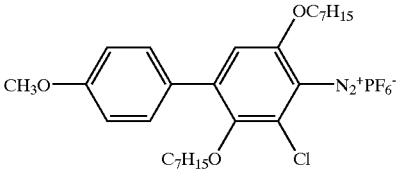

A-14

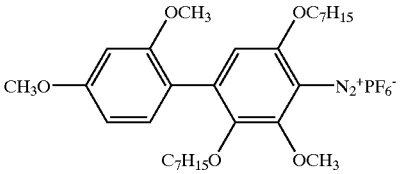

-continued
A-15
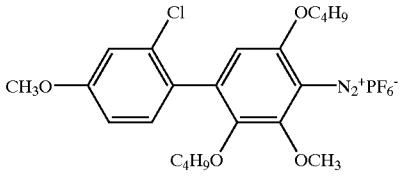
A-16
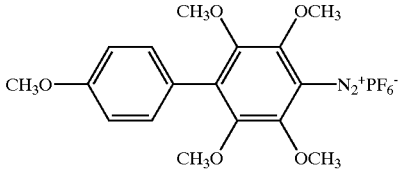
A-17
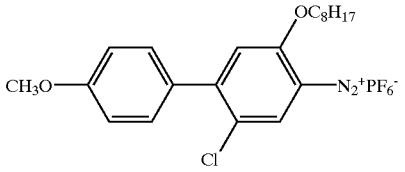
A-18
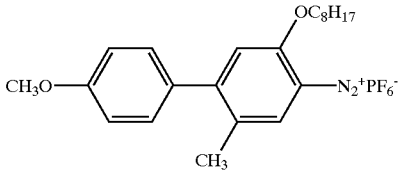
A-19
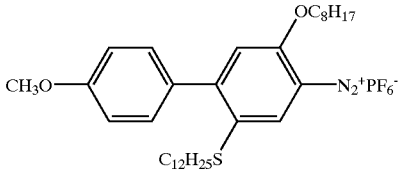
A-20
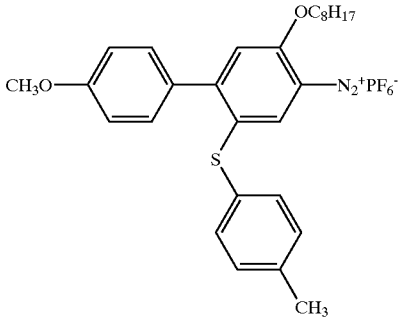
A-21
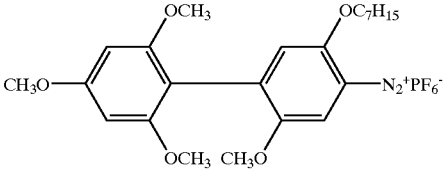
A-22
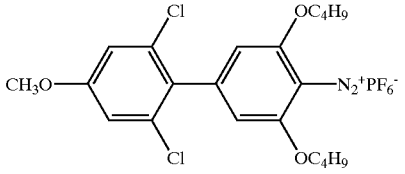
-continued
A-23
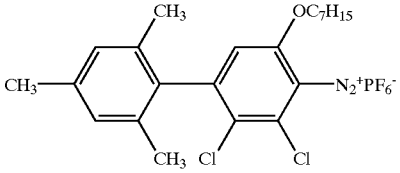
A-24
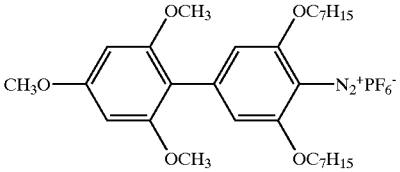
A-25
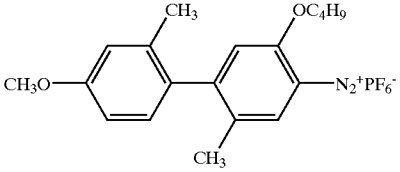
A-26
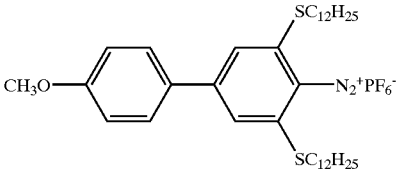
A-27
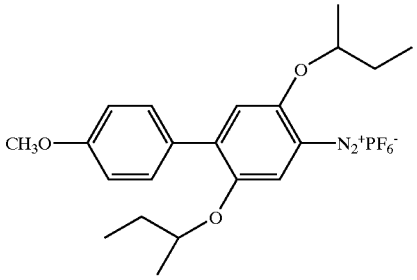
A-28
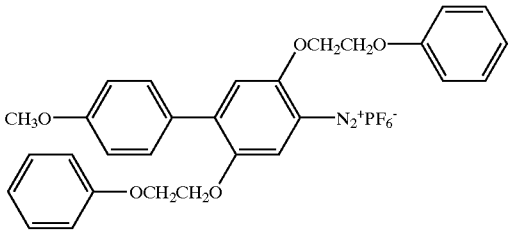
A-29
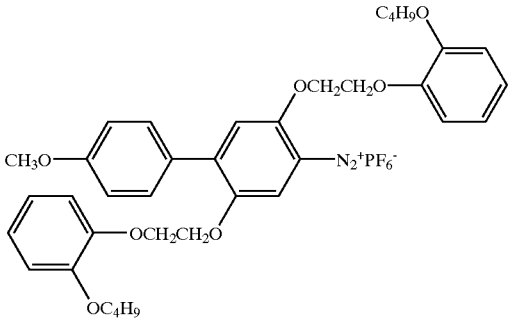

-continued

A-30

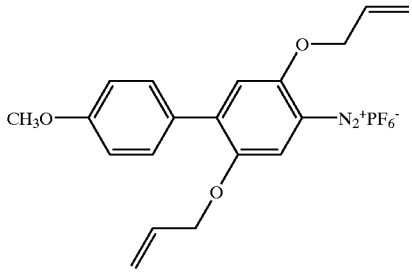

The diazo compound represented by general formula (1) or (2) can be produced by a known method. That is, the diazo compound represented by general formula (1) or (2) can be obtained by diazotizing a corresponding aniline using sodium nitrite, nitrosylsulfuric acid, isoamyl nitrite, or the like in an acidic solvent. A synthesis example of the exemplary compound A-1 is described below.

(Synthesis Example of Exemplary Compound (A-1))

(1) Synthesis example of 2,5-di-n-heptyloxy-4-(4-methoxyphenyl) acetanilide 4.9 grams of 4-acetamide-2,5-(di-n-heptyloxy) iodobenzene and 0.35 gram of $Pd(PPh_3)_4$ were added to 20 milliliters of toluene and atmosphere replacement with nitrogen was carried out. To this solution, a solution containing 2.1 grams of sodium carbonate and 15 milliliters of water and a solution containing 1.83 grams of 4-methoxyphenyl boric acid and 10 milliliters of methanol were added, and were heated and refluxed at a temperature of 120° C. for eight hours. Then, ethyl acetate and water were added and separation of the solution was conducted. Thereafter, the ethyl acetate region was condensed to obtain coarse crystals. The obtained coarse crystals were refined by column chromatography, and 4.5 grams of 2,5-di-n-heptyloxy-4-(4-methoxyphenyl) acetanilide, which was in a form of white crystals, was obtained.

$^1$H-NMR (solvent: $CDCl_3$) δ; 8.19 (s, 1H), 7.77 (br, 1H), 7.20 (d, 2H), 6.94 (d, 2H), 6.78 (s, 1H), 4.00 (t, 2H), 3.94 (t, 2H), 3.86 (s, 3H), 2.21 (s, 3H), 1.75–1.83 (m, 2H), 1.54–1.63 (m, 2H), 1.19–1.49 (m, 16H), 0.81–0.94 (m, 6H)

(2) Synthesis Example of Exemplary Compound A-1 obtained from 2,5-di-n-heptyloxy-4-(4-methoxyphenyl) acetanilide 4.5 grams of 2,5-di-n-heptyloxy-4-(4-methoxyphenyl) acetanilide obtained in (1) was dissolved in 20 milliliters of methanol. Further, 4 milliliters of concentrated hydrochloric acid was added thereto and heated and refluxed for four hours. Then, the reaction solution was cooled to 0° C., and a solution containing 0.83 gram of sodium nitrate and 2 milliliters of water was dropped thereto. The reaction solution was stirred for one hour at a temperature of 10° C. Thereafter, 2.4 grams of potassium hexafluorophosphate was added to the reaction mixture and the reaction mixture was stirred for 30 minutes at room temperature. Then, 10 milliliters of water was added thereto and crystallization was thus carried out. The deposited crystals were collected by filtration, washed with water, then washed with isopropanol, and then, recrystallized using a mixed solvent containing ethyl acetate and isopropanol. Then, the crystals were dried and 3.7 grams of the exemplary compound A-1 was obtained. λ max was 423 nm, and ε was $1.8\times10^4$ for the ultra violet-visible absorption spectrum of the compound A-1 in methanol.

$^1$H-NMR (solvent: $CDCl_3$)δ; 7.89 (s, 1H), 7.58 (d, 2H), 7.12 (s, 1H), 7.02 (d, 2H), 4.36 (t, 2H), 4.08 (t, 2H), 3.86 (s, 3H), 1.87–1.96 (m, 2H), 1.71–1.79 (m, 2H), 1.19–1.49 (m, 16H), 0.81–0.94 (m, 6H)

The compound represented by general formula (1) or (2) may be either an oily material or in one crystal state. However, it is preferably that the material is in crystal state from the viewpoint of ease in handling. The compound represented by general formula (1) or (2) may be used singly or in combination of two or more types thereof. The compound represented by general formula (1) or (2) is preferably used in the heat-sensitive recording layer in a range of 0.02 to 5 g/m$^2$, and from a viewpoint of density of formed color, a range of 0.1 to 4 g/m$^2$ is more preferable, 0.5 to 3 g/m$^2$ is still more preferable.

In addition, in order to stabilize the above-described diazo compound, a complex compound may be formed from the diazo compound using zinc chloride, cadmium chloride, tin chloride, or the like. The diazo compound in a form of a complex may be used singly or in combination of two or more types thereof.

[Coupler]

The above-described heat-sensitive recording layer contains a coupler for causing a coupling reaction with the diazo compound to form an azo dye. A coupler usable in the present invention may be any compound which can couple with the diazo compound in a basic atmosphere and/or in a neutral atmosphere to form a dye. Further, all 4-equivalent couplers which are used for silver halide photographic photosensitive materials can be used for the heat-sensitive recording material of the present invention. Note that, a suitable coupler can be selected from the above couplers listed as usable in the present invention in accordance with the desired.

Examples of a coupler usable, for example, for a so-called active methylene compound having a methylene group next to a carbonyl group include a phenol derivative, a naphthol derivative, and the like, and specific examples thereof are described below. These couplers can be used within a range which suits the purpose of the present invention.

Compounds represented by the following general formula (3) are particularly preferable as the coupler usable in the present invention.

$$E^1—CH_2—E^2 \qquad \text{General Formula (3)}$$

wherein $E^1$ and $E^2$ each independently represent an electron attractive group. $E^1$ and $E^2$ may be bonded with each other to form a ring.

In general formula (3), the electron attractive group represented by $E^1$ and $E^2$ refers to a substituent having a positive Hammett σ. $E^1$ and $E^2$ may be the same or different from each other. Preferable examples of the electron attracting group include an acyl group, an alkoxycarbonyl group, a carbamoyl group, a cyano group, a nitro group, an alkylsulfonyl group, an arylsulfonyl group, a heterocyclic group, a phosphono group, and the like.

Specific examples of the preferable electron attractive group include acyl groups such as an acetyl group, a propionyl group, a pivaloyl group, a chloroacetyl group, a trichloroacetyl group, a trifluoroacetyl group, a 1-methylcyclopropylcarbonyl group, a 1-ethylcyclopropylcarbonyl group, a 1-benzylcyclopropylcarbonyl group, a benzoyl group, a 4-methoxybenzoyl group, a thenoyl group, and the like; oxycarbonyl groups such as a methoxycarbonyl group, an ethoxycarbonyl group, a 2-methoxyethoxycarbonyl group, a 4-methoxyphenoxycarbonyl group, and the like; carbamoyl groups such as a carbamoyl group, an N,N-dimethylcarbamoyl group, an N,N-diethylcarbamoyl group, an N-phenylcarbamoyl group, an N-[2,4-bis(pentyloxy)phenyl]carbamoyl group, an N-[2,4-bis(octyloxy)phenyl]carbamoyl group, a morpholinocarbamoyl group, and the like; alkyl sulfonyl groups and aryl sulfonyl groups such as a methansulfonyl group, a benzenesulfonyl group, a toluenesulfonyl group, and the like; phosphono groups such as a diethylphosphono group, and the like; heterocyclic groups such as a benzoxazole-2-yl group, a benzothiazole-2-yl group, a 3,4-dihydroquinazoline-4-one-2-yl group, a 3,4-dihydroquinazoline-4-sulfon-2-yl group, and the like; a nitro group, an imino group, and a cyano group.

The electron attractive group represented by $E^1$ and $E^2$ may be bonded to each other to form a ring. As a ring formed by $E^1$ and $E^2$, a 5- or 6-membered carbocyclic ring or heterocyclic ring is preferable.

Specific examples thereof include resorcinol, phloroglucinol, 2,3-dihydroxynaphthalene, sodium 2,3-dihydroxynaphthalene-6-sulfonate, 1-hydroxy-2-naphthoic acid morpholonopropylamide, sodium 2-hydroxy-3-naphthalenesulfonate, 2-hydroxy-3-naphthalene sulfonic acid anilide, 2-hydroxy-3-naphtalensulfonic acid morpholinopropylamide, 2-hydroxy-3-naphthalenesulfonic acid-2-ethylhexyloxypropylamide, 2-hydroxy-3-naphthalenesulfonic acid-2-ethylhexylamide, 5-acetamide-1-naphthol, sodium 1-hydroxy-8-acetamidenaphthalene-3,6-disulfonate, 1-hydroxy-8-acetamidenaphthalene-3,6-disulfonic acid dianilide, 1,5-dihydroxynaphthalene, 2-hydroxy-3-naphthoic acid morpholinopropylamide, 2-hydroxy-3-naphthoic acid octyl amide, 2-hydroxy-3-naphthoic acid anilide, 5,5-dimethyl-1,3-cyclohexanedione, 1,3-cyclopentadione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamide-5-pyrazolone, 6-hydroxy-4-methyl-3-cyano-1-(2-ethylhexyl)-2-pyridone, 2,4-bis-(benzoylacetamide)toluene, 1,3-bis-(pivaloylacetamidemethyl) benzene, benzoylacetonitrile, thenoylacetonitrile, acetoacetoanilide, benzoylacetoanilide, pivaloylacetoanilide, 2-chloro-5-(N-n-butylsulfamoyl)-1-pivaloylacetamidebenzene, 1-(2-ethylhexyloxypropyl)-3-cyano-4-methyl-6-hydroxy-1,2-dihydropyridine-2-one, 1-(dodecyloxypropyl)-3-acetyl-4-methyl-6-hydroxy-1,2-dihydropyridine-2-one, 1-(4-n-octyloxyphenyl)-3-tert-butyl-5-aminopyrazole, and the like.

Details of the above-described couplers are described in Japanese Patent Application Laid-Open (JP-A) Nos. 4-201483, 7-223367, 7-223368, 7-323660, Japanese Patent Application Nos. 5-278608, 5-297024, 6-18669, 6-18670, 7-316280, 8-027095, 8-027096, 8-030799, 8-12610, 8-132394, 8-358755, 8-358756, 9-069990, and the like.

Specific examples of the couplers represented by general formula (3) are shown below, however, these are not intended to limit the present invention. Note that, tautomers of the couplers shown below are also preferable for use as couplers of the present invention.

B-1

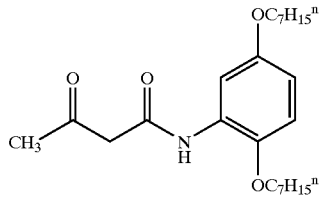

B-2

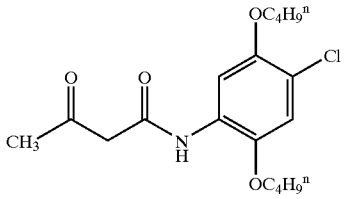

B-3

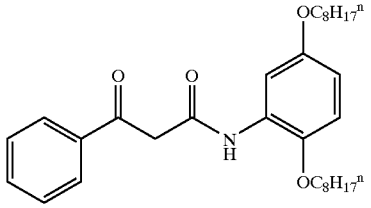

B-4

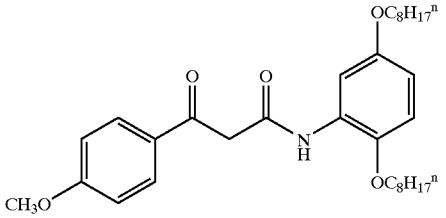

B-5

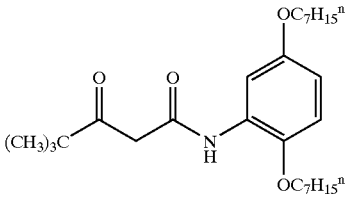

B-6

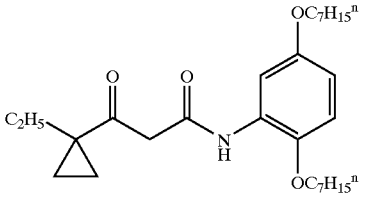

B-7

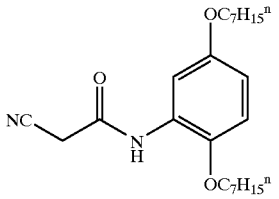

-continued
B-8
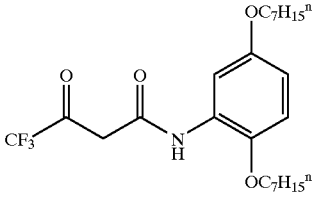
B-9
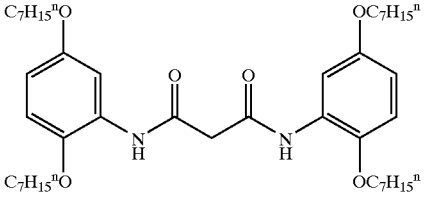
B-10
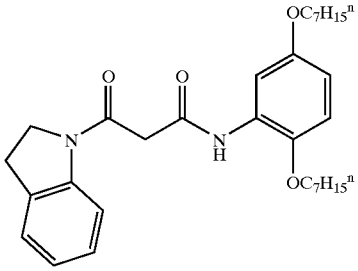
B-11
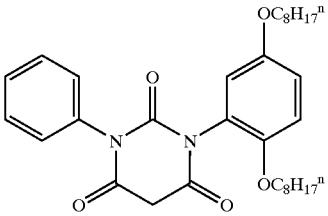
B-12
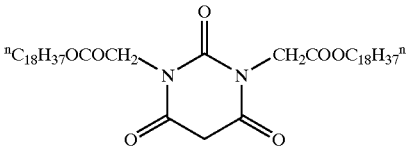
B-13
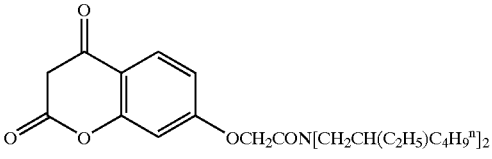
B-14
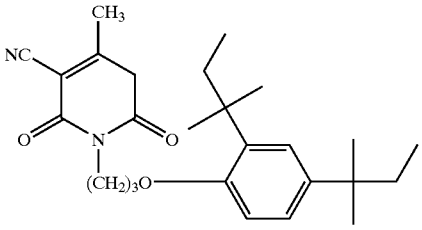
-continued
B-15
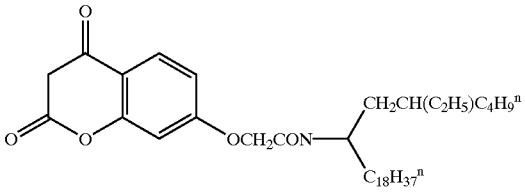
B-16
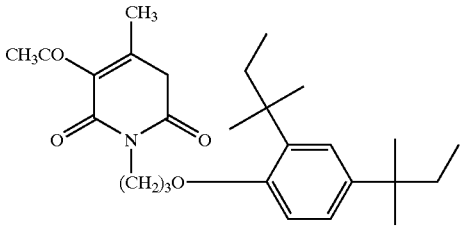
B-17
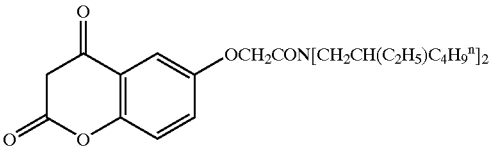
B-18
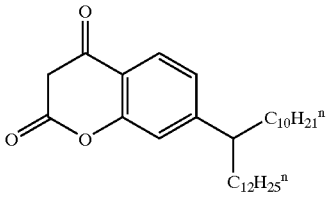
B-19
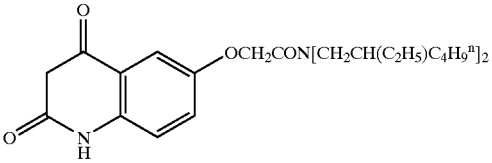
B-20
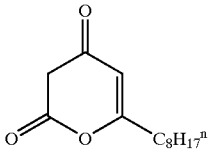
B-21
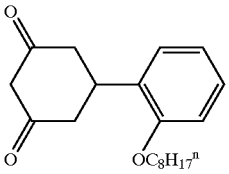
B-22
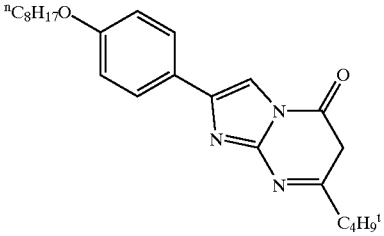

-continued

B-23

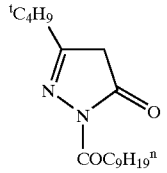

B-24

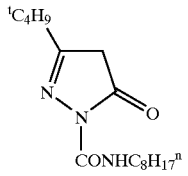

B-25

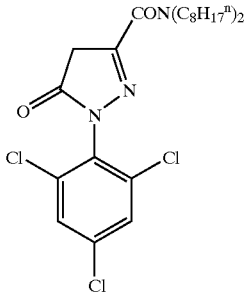

B-26

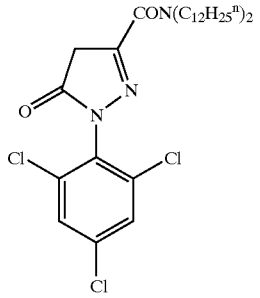

B-27

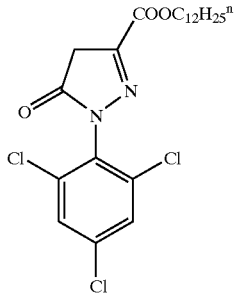

B-28

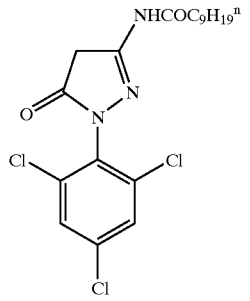

-continued

B-29

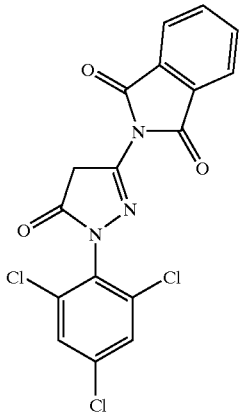

[Microcapsule]

The heat-sensitive recording material of the present invention is characterized in that it contains the diazo compound in a state in which the diazo compound is encapsulated in microcapsules in order to improve storability thereof before use. A high polymer forming capsule walls of the microcapsules is impermeable at room temperature, and is required to become permeable when heated. Particularly, one having a glass-transition temperature of 60 to 200° C. is preferable, 70 to 180° C. is more preferable, and 80 to 160° C. is still more preferable. Examples of the high polymer forming the capsule walls of the microcapsules include polyurethane, polyurea, polyamide, polyester, urea-formaldehyde resin, melamine resin, polystyrene, styrene-methacrylate copolymer, styrene-acrylate copolymer, and mixtures thereof. Since color-formation (fogging) on stored recording material before use is small, and density of formed color after printing is high in the present invention, the capsule walls preferably contain polyurethane and/or polyurea as the polymer forming the capsule walls.

Known capsule-forming methods can be used to form the microcapsules. Among them, interfacial polymerization and internal polymerization are suitable. Details of the capsule forming methods and specific examples of reactants are described in U.S. Pat. Nos. 3,726,804, 3,796,669, and the like. For example, when polyurea and polyurethane are used as materials for the capsule walls, polyisocyanate and a second substance which reacts with the polyisocyanate to form the capsule walls (such as polyol or polyamine) are mixed in an aqueous medium or in an oily medium to be encapsulated. Then, the mixture is emulsified in water, and then heated, whereby a polymerization is caused at the interfaces of the oil drops to form microcapsule walls. Note that, polyurea is formed even when the second substance is not added.

A method for producing the microcapsules (polyurea/polyurethane wall) for encapsulating the diazo compound in the present invention is described below.

First, the diazo compound is dissolved or dispersed in a hydrophobic organic solvent which becomes the core of the capsules. As the organic solvent used in this case, one having a boiling point in a range of 100 to 300° C. is preferable. Further, polyvalent isocyanate is added into the core solvent as a wall material (an oil phase).

On the other hand, as an aqueous phase, an aqueous solution containing a water-soluble polymer such as polyvinyl alcohol, gelatin, or the like, dissolved therein is prepared, and then, the oil phase is added thereto. The mixture is agitated into an emulsion state using a homogenizer or the like. At this time, the water-soluble polymer acts as a stabilizer for the emulsified dispersion. Further, a surfactant may be added into at least one of the oil phase or the aqueous phase in order to carry out the emulsion more stably.

An amount of the polyvalent isocyanate to be used is determined so that an average particle diameter of the obtained microcapsules is 0.3 to 12 $\mu$m and a wall thickness thereof is 0.01 to 0.3 $\mu$m. Diameters of dispersed particles are generally in a range from about 0.2 to 10 $\mu$m. In the emulsified dispersion, a polymerization reaction of polyisocyanate is caused at interfaces between the oil phase and the aqueous phase, and polyurea walls are formed.

By adding polyol in the aqueous phase in advance, the polyvalent isocyanate reacts with the polyol, whereby polyurethane walls can be formed. In order to accelerate the reaction rate, it is preferable to keep the reaction temperature high, and/or to add a suitable polymerization catalyst. Details of the polyisocyanate, the polyol, the reaction catalyst, the polyamine for forming the wall, and the like are described in publications such as "Polyurethane Handbook", edited by Keiji Iwata, published by Nikkan Kogyo Shinbunsha (1987).

As the polyvalent isocyanate compound used as the material for the capsule wall, a trifunctional or higher-functional isocyanate compound is preferable, however, a difunctional isocyanate compound may be used in combination with the above-mentioned isocyanate compound having three or more groups. Specifically, examples of these compounds include dimers or trimers (biurets or isocyanurates) of diisocyanate such as xylene diisocyanate and hydrogenated products thereof, hexamethylene diisocyanate, tolylene diisocyanate and hydrogenated products thereof, isophorone diisocyanate, and the like; polyfunctional isocyanate compounds obtained as adducts of polyol such as trimethylolpropane and bifunctional isocyanate such as xylene diisocyanate; compounds obtained by introducing high molecular weight compound such as polyether having active hydrogen such as polyethylene oxide into an adduct of polyol such as trimethylolpropane and bifunctional isocyanate such as xylene diisocyanate; a formalin condensate of benzene isocyanate; and the like. Those compounds described in JP-A Nos. 62-212190, 4-26189, 5-317694, Japanese Patent Application No. 8-268721, and the like, are preferable.

Further, polyol or polyamine is added in advance to a hydrophobic solvent which becomes the core of the microcapsule or to a solution of a water-soluble polymer which becomes a dispersion medium in order to be used as one of materials for the walls of microcapsules. Specific examples of the polyol or polyamine include propylene glycol, glycerine, trimethylolpropane, triethanolamine, sorbitol, hexamethylene diamine, and the like. When polyol is added, polyurethane walls are formed.

As the hydrophobic organic solvent used for dissolving the diazo compound to form cores of microcapsules, one having a boiling point in a range from 100° C. to 300° C. is preferable. Specific examples thereof include alkylnaphthalene, alkyldiphenylethane, alkyldiphenylmethane, alkylbiphenyl, alkylterphenyl, chlorinated paraffin, phosphates, maleates, adipates, phthalates, benzoates, carbonates, ethers, sulfates, sulfonates, compounds described in Japanese Patent Application Nos. 11-317869 and 11-369276, and the like. These may be used singly or in combination thereof.

When solubility, in these solvents, of the diazo compound to be encapsulated is low, a low-boiling-point solvent in which the diazo compound to be used is highly soluble can be used in combination with the solvent as an auxiliary solvent. Specific examples thereof include ethyl acetate, butyl acetate, methylene chloride, tetrahydrofuran, acetonitrile, acetone, and the like. Accordingly, it is preferable that the diazo compound has an appropriate solubility in these high-boiling-point hydrophobic organic solvents and low-boiling-point assistant solvents. Specifically, solubility of the diazo compound in these solvents is preferably 5% or more. While, solubility of the diazo compound in water is preferably 1% or less.

The water-soluble polymer used for the water-soluble polymer aqueous solution for dispersing the oil phase of the capsules thus prepared, is preferably one having solubility in water of 5% or more at a temperature at which emulsification is carried out. Specific examples thereof include polyvinyl alcohol and modified compound thereof, polyacrylic amide and derivatives thereof, ethylene-vinyl acetate copolymer, styrene-maleic anhydride copolymer, ethylene-maleic anhydride copolymer, isobutylene-maleic anhydride copolymer, polyvinylpyrolidone, ethylene-acrylic acid copolymer, vinyl acetate-acrylic acid copolymer, carboxymethylcellulose, methylcellulose, casein, gelatin, starch derivatives, gum arabic, sodium alginate, and the like.

These water-soluble polymers preferably have no reactivity or low reactivity with isocyanate compounds. For example, those having reactive amino groups in the molecular chain thereof such as gelatin need to be modified in advance, or the like, so that they lose reactivity. Further, if a surfactant is added, an amount thereof to be added is preferably 0.1 to 5%, more preferably 0.5 to 2% of the mass of the oil phase.

Emulsification can be carried out using a known emulsifying device such as a homogenizer, a Manton Gaulin, an ultrasonic disperser, a dissolver, a KD mill, or the like. After the emulsification, the emulsion is heated up to 30 to 70° C. in order to accelerate the capsule wall forming reaction. In order to prevent coagulation of the capsules, it is necessary to add water to lower the possibility of collision between the microcapsules, or to stir the emulsion well, or the like, during the reaction.

In addition, a dispersant may be added again during the reaction for preventing coagulation. As the polymerizing reaction progresses, generation of carbon dioxide is observed, and when the generation of carbon dioxide ends, it can be considered that the capsule wall forming reaction is completed. Usually, the desired microcapsules which encapsulate the diazo compound can be obtained after carrying out the reaction for several hours.

(Surfactant)

The coupler used in the present invention can be used in a state in which it is dispersed in the solid state with the water-soluble polymer, by sand mill or the like and a basic material and other color-formation aids can be also dispersed therewith. However, the coupler is preferably used in a state of an emulsified dispersion prepared by dissolving the coupler in an organic solvent which is slightly soluble or insoluble in water and mixing the obtained solution with an aqueous phase which contains a surfactant and/or a water-soluble polymer as protective colloids. It is preferable to use a surfactant from the viewpoint of facilitating dispersion and emulsification.

The organic solvent used in this case can be suitably selected from high-boiling-point oils described in JP-A No. 2-141279, for example. Among them, esters are preferably used from a viewpoint of stability of the emulsion state of the emulsified dispersion, and tricresyl phosphate is particularly preferable. These oils can also be used in combination thereof or in combination with other oils.

Further, an auxiliary solvent may be added to the above-described organic solvent as a low-boiling-point dissolution aid. Particularly preferable examples of such an auxiliary solvent include ethyl acetate, isopropyl acetate, butyl acetate, methylene chloride, and the like. In some cases, the low-boiling-point auxiliary solvent can be used singly without containing the high-boiling-point oil.

The water-soluble polymer contained, as protective colloids, in the aqueous phase which is to be mixed with the oil phase containing these components can be suitably selected from known anionic polymers, nonionic polymers and amphoteric polymers. Examples of preferable water-soluble polymers include polyvinyl alcohol, gelatin, cellulose derivatives, and the like.

The surfactant to be contained in the aqueous phase can be suitably selected from anionic or nonionic surfactants which do not cause deposition or coagulation by acting on the protective colloids. Examples of preferable surfactants include sodium alkylbenzene sulfonate, sodium alkyl sulfate, sodium dioctyl sulfosuccinate, polyalkylene glycol (such as polyoxyethylene nonylphenyl ether), and the like.

(Organic Base)

In the present invention, an organic base may also be added in order to accelerate the coupling reaction between the diazo compound and the coupler. The organic base may be used singly or in combination of two or more types thereof. Examples of the organic base include nitrogen-containing compounds such as tertiary amines, piperidines, piperazines, amidines, formamidines, pyridines, guanidines, morpholines, and the like, and those described in Japanese Patent Application Publication (JP-B) No. 52-46806, JP-A Nos. 62-70082, 57-169745, 60-94381, 57-123086, 58-1347901, 60-49991, JP-B Nos. 2-24916, 2-28479, and JP-A Nos. 60-165288, 57-185430 can be used.

Among them, those particularly preferable are piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxylphenoxy)-2-hydroxypropyl]piperazine, N,N'-bis(3-phenylthio-2-hydroxypropyl]piperazine, N,N'-bis[3-(β-naphthoxy)-2-hydroxypropyl]piperazine, N-3-(β-naphthoxy)-2-hydroxypropyl-N'-methylpiperazine, 1,4-bis{[3-(N-methylpiperazino)-2-hydroxy]propyloxy}benzene, and the like; morpholines such as N-[3-(β-naphthoxy)-2-hydroxy]propylmorpholine, 1,4-bis(3-morpholino-2-hydroxypropyloxy)benzene, 1,3-bis(3-morpholino-2-hydroxypropyloxy)benzene, and the like; piperidines such as N-(3-phenoxy-2-hydroxypropyl)piperidine, N-dodecylpiperidine, and the like; and guanidines such as triphenylguanidine, tricyclohexylguanidine, dicyclohexylphenylguanidine, and the like.

In the present invention, an amount of the coupler and an amount of the organic base to be used are each preferably 0.1 to 30 parts by mass, more preferably 0.5 to 20 parts by mass, and still more preferably 1 to 10 parts by mass to 1 part by mass of the diazo compound.

(Color-Formation Aid)

Besides the above-described organic base, a color-formation aid may be added in order to accelerate the color-forming reaction in the present invention. The color-forming aid is a substance which increases density of the color formed at a time of thermal-recording, or lowers the minimum color-forming temperature. By lowering the melting point of the coupler, the basic substance, or the diazo compound, or by lowering the softening point of the capsule walls, the color-formation aid provides to make conditions under which the diazo compound, the basic substance, the coupler and the like easily react.

For example, in order to perform thermal printing rapidly and completely using low energy, phenol derivatives, naphthol derivatives, alkoxy-substituted benzenes, alkoxy-substituted naphthalenes, aromatic ethers, thioethers, esters, amides, ureidos, urethanes, sulfonamide compounds, hydroxy compounds, and the like, can be added in the recording layer as the color-formation aids in the present invention.

(Antioxidant)

In the heat-sensitive recording material of the present invention, in order to increase fastness of a thermally-color-formed image against light and heat, or reduce yellowing of unprinted areas after fixing due to light, known antioxidants shown below, and the like, are preferably used. Known antioxidants are described, for example, in European Patent Application Laid-open Nos. 223739, 309401, 309402, 310551, 310552, 459416, German Patent Application Laid-open No. 3435443, JP-A Nos. 54-48535, 62-262047, 63-113536, 63-163351,2-262654, 2-71262, 3-121449, 5-61166, 5-119449, U.S. Pat. Nos. 4,814,262, 4,980,275, and the like.

Further, in the present invention, various known additives which have been used in heat-sensitive recording materials and pressure-sensitive recording materials can be effectively used. Specific examples of various additives include compounds described in JP-A Nos. 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 63-051174, 63-89877, 63-88380, 63-088381, 63-203372, 63-224989, 63-251282, 63-267594, 63-182484, 1-239282, 4-291685, 4-291684, 5-188687, 5-188686, 5-110490, 5-1108437, 5-170361, JP-B Nos. 48-043294, 48-033212, and the like.

Specifically, 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxy-diphenylamine, 1-methyl-2-phenylindole, and the like, are included.

An amount of these antioxidants and various additives to be added is preferably 0.05 to 100 parts by mass, and most preferably 0.2 to 30 parts by mass to 1 part by mass of the diazo compound. The known antioxidants and various additives described above may be used in a state in which they are encapsulated in microcapsules together with the diazo compound, on in a state in which they are dispersed in solid state together with the coupler, the basic substance, and other color-formation aids, or in emulsion state together with a suitable emulsification aid, or in both of the above-mentioned states. Of course, the antioxidants and various additives can be used singly or in combination thereof. Further, they can be added to the protective layer, or the protective layer can be formed so as to contain them.

The antioxidants and various additives are not necessarily added in the same layer. Further, when a plurality of the antioxidants and various additives are used in combination, they can be classified according to their structures, such as into anilines, alkoxybenzenes, hindered phenols, hindered amines, hydroquinone derivatives, phosphorus compounds, sulfur compounds, and the like, and those having different structures may be combined, or those having the same structure may be combined.

(Free Radical Generating Agent, etc.)

In the heat-sensitive recording material of the present invention, a free radical generating agent (a compound which generates free radical when exposed to light) which is used for photo-polymerizing compositions and the like may be added in order to reduce yellowing of background areas after recording. Examples of the free radical generating agent include aromatic ketones, quinones, benzoin, benzoin ethers, azo compounds, organic disulfides, acyloxime esters, and the like. An amount of the free radical generating agent to be added is preferably 0.01 to 5 parts by mass to 1 part by mass of the diazo compound.

Similarly, in order to reduce yellowing, a polymerizable compound having an ethylenically unsaturated bond (hereinafter referred to as vinyl monomer) can be used. The vinyl monomer is a compound which has at least one ethylenically unsaturated bond (such as a vinyl group, a vinylidene group, and the like) in the chemical structure thereof, and has a chemical form of a monomer or a prepolymer. Examples thereof include unsaturated carboxylic acid and salts thereof, esters of unsaturated carboxylic acid and aliphatic polyalcohol, amides of unsaturated carboxylic acid and aliphatic polyamine compound, and the like. An amount of the vinyl monomer to be used is 0.2 to 20 parts by mass to 1 part of the diazo compound. The free radical generating agent and the vinyl monomer described above may be used in a state in which they are contained in microcapsules together with the diazo compound.

Besides the above-described materials, citric acid, tartaric acid, oxalic acid, boric acid, phosphoric acid, pyrophosphoric acid, and the like, can be added as an acid stabilizer in the present invention.

<<Preparation Method of Heat-Sensitive Recording Material>>

In the heat-sensitive recording material of the present invention, the heat-sensitive layer is preferably provided by preparing a coating solution which contains the diazo-compound-containing microcapsules, the coupler, the organic base and other additives, then, coating the coating solution onto a support such as paper or synthetic resin film using a known coating method such as bar coating, blade coating, air knife coating, gravure coating, roll coating, spray coating, dip coating, curtain coating, or the like, and drying. The heat-sensitive layer contains preferably 2.5 to 30 $g/m^2$ solid components, more preferably 3.0 to 25 $g/m^2$ solid component, and sill more preferably 3.5 to 20 $g/m^2$ solid components. In the heat-sensitive recording material of the present invention, the microcapsules, the coupling components, the base, and the like may be contained in the same layer, or may be contained in separate layers as in a laminated structure. That is, the heat-sensitive layer may be a laminated type heat-sensitive layer which actually includes a plurality of layers. Further, the heat-sensitive layer may be coated after an intermediate layer, such as described in Japanese Patent Application No. 59-177669, and the like, is provided on a support.

As a binder used in the heat-sensitive recording material of the present invention, a known water-soluble polymer, a latex, or the like, can be used. Examples of the water-soluble polymer include methyl cellulose, carboxymethyl cellulose, hydroxyethyl cellulose, hydroxypropyl cellulose, starch derivatives, casein, gum arabic, gelatin, ethylene-maleic anhydride copolymer, styrene-maleic anhydride copolymer, polyvinyl alcohol, epichlorohydrine modified polyamide, isobutylene-maleic anhydride salicylic acid copolymer, polyacrylic acid, polyacrylamide, and the like, and modified compounds thereof, and the like. Examples of the latex include styrene-butadiene rubber latex, methyl acrylate-butadiene rubber latex, vinyl acetate emulsion, and the like.

In the heat-sensitive recording material of the present invention, known organic and inorganic pigments can be used. Specific examples thereof include kaolin, calcined kaolin, talc, agalmatolite, diatom earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, micro balloon, urea-formalin filler, polyester particle, cellulose filler, and the like.

In the heat-sensitive recording material of the present invention, various additives such as a known wax, an antistatic agent, a defoaming agent, a conductive agent, a fluorescent dye, a surfactant, an ultraviolet ray absorbent and a precursor thereof, and the like, can be used as necessary.

<Protective Layer>

The heat-sensitive recording material of the present invention may be provided with a protective layer on a surface of the recording layer as necessary. The protective layer may be formed by two or more laminated layers as necessary. Examples of materials used in the protective layer include water-soluble polymers such as polyvinyl alcohol, carboxy modified polyvinyl alcohol, vinyl acetate-acrylamide copolymer, silicon modified polyvinyl alcohol, starch, modified starch, methyl cellulose, carboxymethyl cellulose, hydroxymethyl cellulose, gelatins, gum arabic, casein, hydrolysates of styrene-maleic acid copolymer, half-ester hydrolysates of styrene-maleic acid copolymer, hydrolysates of isobutylene-maleic anhydride copolymer, polyacrylamide derivatives, polyvinyl pyrolidone, sodium polystyrene sulfonate, sodium alginate, and the like; and latexes such as styrene-butadiene rubber latex, acrylonitrile-butadiene rubber latex, methyl acrylate-butadiene rubber latex, vinyl acetate emulsion, and the like. By cross-linking the water-soluble polymer in the protective layer, stability of stored recording materials can be further improved. A known cross-linking agent can be used to cross-link the water-soluble polymer. Specific examples thereof include water-soluble primary condensates such as N-methylolurea, N-methylolmelamine and urea-formalin; dialdehyde compounds such as glyoxal and glutaraldehyde; inorganic-type cross-linking agents such as boric acid and borax, polyamide epichlorohydrine, and the like. Further, known pigments, a metallic soap, a wax, a surfactant, and the like, can be used in the protective layer. An amount of the protective layer to be coated is preferably 0.2 to 5 $g/m^2$, more preferably 0.5 to 2 $g/m^2$. A thickness thereof is preferably 0.2 to 5 $\mu$m, more preferably 0.5 to 2 $\mu$m. When the protective layer is used in the heat-sensitive recording material of the present invention, a known ultraviolet ray absorbent or a precursor thereof may be contained in the protective layer.

<Support>

As the support in the present invention, any of paper supports used for ordinary pressure-sensitive paper and heat-sensitive paper, dry-type or wet-type diazo copy paper, and the like can be used. Besides these, acidic paper, neutral paper, coated paper, plastic-film-laminated paper, synthetic paper, plastic film, and the like, can be used. In order to correct curl balance of the support, or to increase chemical resistance at a back side thereof, a back-coat layer may be provided. Further, the support may be formed so that it has a label by providing an adhesive layer at a back side thereof and combining it with a separate paper. The back-coat layer can be provided in the same manner as the above-described protective layer.

When a recording surface of the heat-sensitive recording material of the present invention is heated with a thermal head or the like, capsule walls made of polyurea and/or polyurethane soften, and the coupler and the basic compound outside the capsules enter the capsules to form a color. After the color is formed, an image fixing is carried out by irradiating light having a wavelength in a range of the absorption wavelength of the diazo compound in order to decompose the diazo compound so that the diazo compound loses its reactivity with the coupler.

As a light source for the above-described fixing, various fluorescent lights, a xenon lamp, a mercury lamp, and the like are used. In order to perform fixing effectively, it is preferable that an emission spectrum of the light source approximately coincides with the absorption spectrum of the diazo compound used in the heat-sensitive recording material. In the present invention, a light source whose emission center wavelength is longer than 400 nm is particularly preferable.

Further, in the present invention, by using photodecomposing diazo compounds having different photodecomposition wavelengths in separate layers, a multi-color recording material can be produced.

When the heat-sensitive recording material of the present invention is produced as a multi-layered multi-color heat-sensitive recording material, intermediate layer(s) may be provided between the heat-sensitive recording layers in order to prevent colors of respective layers from being mixed. The intermediate layers are formed of a water-soluble polymer such as gelatin, phthalized gelatin, polyvinyl alcohol, polyvinyl pyrolidone, or the like, and may contain various additives as necessary.

EXAMPLES

Hereinafter, the present invention is described in more detail using examples. However, these examples are not intended to limit the present invention.

Example 1

(Preparation of Diazo Compound-Containing Microcapsule Solution A)

2.8 grams of diazo compound (the exemplary compound (A-1)) and 10 grams of tricresyl phosphate were added to 19 grams of ethyl acetate, and were mixed homogeneously. Then, this mixed solution, 7.6 grams of Takenate D110N (produced by Takeda Chemical Industries, Ltd.) was added as a wall material and mixed to obtain solution 1. Next, the solution 1 was added into a mixed solution containing 46 grams of 8% aqueous phthalated gelatin solution, 17.5 grams of water and 2 grams of 10% aqueous solution of sodium dodecylbenzene sulfonate, and the mixed solution was emulsified state using a homogenizer for 10 minutes at 10,000 rpm at 40° C. Then, 20 grams of water was added into the obtained emulsion and the mixture was homogenized. Then, a capsule-forming reaction was carried out for 3 hours at 40° C. while the emulsion was being stirred, to obtain capsule solution A. The average particle diameter of the capsules was 0.6 to 0.8 $\mu$m.

(Preparation of Coupler Emulsion B)

3 grams of coupler (B-1), 3 grams of triphenyl guanidine, 0.5 gram of tricresyl phosphate and 0.24 gram of diethyl maleate were dissolved in 10.5 grams of ethyl acetate to obtain solution 2. Then, 49 grams of 15% aqueous solution of lime-treated gelatin, 9.5 grams of 10% aqueous solution of sodium dodecylbenzene sulfonate and 35 grams of water were mixed homogeneously at 40° C., and the solution 2 was added thereto. The mixed solution was emulsified using a homogenizer for 10 minutes at 10,000 rpm at 40° C. The obtained emulsion was stirred for 2 hours at 40° C. and ethyl acetate was removed. Then, water was added in order to compensate for amount of ethyl acetate and water which evaporated to obtain coupler emulsion B.

(Preparation of Heat-Sensitive Recording Layer Coating Solution C)

3.6 grams of the capsule solution A, 3.3 grams of water and 9.5 grams of the coupler emulsion B were mixed to obtain heat-sensitive recording layer coating solution C.

(Preparation of Protective Layer Coating Solution D)

100 grams of 6% aqueous solution of itaconic acid modified polyvinyl alcohol (KL-318: trade name, produced by Kuraray Co., Ltd.) and 10 grams of 30% dispersion of epoxy modified polyamide (FL-71: trade name, produced by Toho Chemical Industry Co., Ltd.) were mixed, and 15 grams of 40% dispersion of zinc stearate (Hydrine Z: trade name, produced by Chukyo-Yushi Co., Ltd.) was homogeneously mixed thereto to obtain protective layer coating solution D.

(Coating)

A support for photographic paper (woodfree paper laminated with polyethylene) was prepared as a support. On this support for photographic paper, the heat-sensitive recording layer coating solution C and the protective layer coating solution D were coated in this order using a wire bar, and were dried at 50° C. to obtain a heat-sensitive recording material of Example 1. A coated amount of the heat-sensitive recording layer as solid component was 6.0 g/m$^2$, and a coated amount of the protective layer as solid component was 1.2 g/m$^2$.

(Color-formation Test)

A thermal printing was performed on the heat-sensitive recording material to obtain an image using a thermal head produced by Kyocera Corporation (KST-type). An applied power and a pulse width for the thermal head were determined so that recording energy per unit area was 50 mj/mm$^2$. The obtained image was exposed to an ultraviolet ray for 10 seconds using an ultraviolet lamp having an emission center wavelength of 420 nm and power of 40 W. Then, density of a color which was formed and density of a background area (density of a non-image area) were measured. Results are shown in Table 1.

(Light Fastness Test)

A portion where a color was formed using a thermal head produced by Kyocera Corporation (KST-type) was irradiated for 24 hours at 30,000 lux using a fluorescent lamp tester. Then, density of the color-formed portion was measured. Results are shown in Table 1.

(Photo-Fixing Property Test)

A surface of the protective layer of the above-described heat-sensitive recording material was exposed to an ultraviolet ray for 7 seconds using an ultraviolet lamp having an emission center wavelength of 420 nm and power of 40 W. Then, the above-described color-formation test was carried out. Results are shown in Table 1.

(Measurement of Density)

In the above-described color-formation test and light fastness test, image density and density of background areas were measured using Macbeth densitometer RD918, at Y-position.

Example 2

A heat-sensitive recording material of Example 2 was prepared in the same manner as Example 1, except that the exemplary compound (A-2) shown above was used as the diazo compound instead of the exemplary compound (A-1). Then, the above-described color-formation test, light fastness test and photo-fixing property test were carried out. Results are shown in Table 1.

Example 3

A heat-sensitive recording material of Example 3 was prepared in the same manner as Example 1, except that the exemplary compound (A-4) was used as the diazo compound instead of the exemplary compound (A-1). Then, the above-described color-formation test, light fastness test and photo-fixing property test were carried out. Results are shown in Table 1.

Example 4

A heat-sensitive recording material of Example 4 was prepared in the same manner as Example 1, except that the exemplary compound (A-11) was used as the diazo compound instead of the exemplary compound (A-1). Then, the above-described color-formation test, light fastness test and photo-fixing property test were carried out. Results are shown in Table 1.

Comparative Example 1

A heat-sensitive recording material of Comparative Example 1 was prepared in the same manner as Example 1, except that 2,5-dibutyl-4-morpholinobenzenediazonium hexafluorophosphate was used as the diazo compound instead of the exemplary compound (A-1). Then, the above-described color-formation test, light fastness test and photo-fixing property test were carried out. Results are shown in Table 1.

Comparative Example 2

A heat-sensitive recording material of Comparative Example 2 was prepared in the same manner as Example 1, except that 2,5-dibutyl-4-(4-methylthiophenyl) benzenediazonium hexafluorophosphate was used as the diazo compound instead of the exemplary compound (A-1). Then, the above-described color-formation test, light fastness test and photo-fixing property test were carried out. Results are shown in Table 1.

TABLE 1

| | Color-formation test | | Light fastness test Density of | Photo-fixing property test | |
|---|---|---|---|---|---|
| | Density of formed color | Density of background | color-formed portion | Density of formed color | Density of background |
| Example 1 | 1.52 | 0.08 | 1.38 | 0.15 | 0.08 |
| Example 2 | 1.52 | 0.08 | 1.37 | 0.15 | 0.08 |
| Example 3 | 1.48 | 0.08 | 1.38 | 0.20 | 0.08 |
| Example 4 | 1.43 | 0.07 | 1.35 | 0.16 | 0.08 |
| Comparative Example 1 | 1.50 | 0.07 | 1.16 | 0.29 | 0.10 |
| Comparative Example 2 | 1.52 | 0.09 | 1.25 | 0.31 | 0.09 |

As can be seen from the results shown in Table 1, the examples in which the diazo compounds according to the present invention were used have exhibited lower density in background areas (fogging in the background areas were lower) and lower density of the color which was formed after photo-fixing, i.e., more excellent photo-fixing properties in comparison with the comparative examples.

By including the diazo compound according to the present invention in the heat-sensitive recording layer of the heat-sensitive recording material in a state in which it is encapsulated in the microcapsules, a heat-sensitive recording material which is excellent in photo-fixing property when a light source emitting light having a wavelength longer than 400 nm is used, and has low color formation in background areas is provided.

What is claimed is:

1. A heat-sensitive recording material comprising a support and at least one heat-sensitive recording layer, wherein the heat-sensitive recording layer comprises at least one diazo compound and at least one coupler, and the at least one diazo compound is encapsulated in microcapsules and is represented by the following general formula (1):

General formula (1)

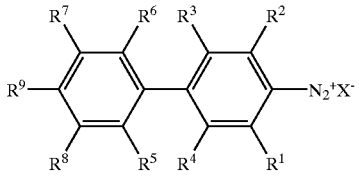

wherein $R^1$, $R^2$, $R^3$, $R^4$, $R^5$, $R^6$, $R^7$ and $R^8$ each independently represents a hydrogen atom, a halogen, an alkyl group, an alkoxy group, an alkylthio group or an arylthio group; $R^9$ represents a hydrogen atom, an alkyl group or an alkoxy group; and $X^-$ represents an anion.

2. The heat-sensitive recording material according to claim 1, wherein the coupler is represented by the following general formula (3):

$$E^1—CH_2—E^2$$ General formula (3)

wherein $E^1$ and $E^2$ each independently represents an electron attractive group and $E^1$ and $E^2$ may be bonded to each other to form a ring.

3. The heat-sensitive recording material according to claim 1, wherein capsule walls of the microcapsules comprise at least one of polyurethane and polyurea.

4. The heat-sensitive recording material according to claim 1, wherein the halogen is a chlorine atom or a bromine atom.

5. The heat-sensitive recording material according to claim 1, wherein the alkyl group, the alkoxy group, the alkylthio group or the arylthio group has 1 to 30 carbon atoms.

6. The heat-sensitive recording material according to claim 1, wherein the $X^-$ is selected from a group consisting of a hexafluorophosphoric ion, a borofluoride ion, a chloride ion, a sulfuric ion, a polyfluoroalkylcarboxylic acid ion, a polyfluoroalkylsulfonic acid ion, a tetraphenylboric acid ion, an aromatic carboxylic acid ion and an aromatic sulfonic acid ion.

7. The heat-sensitive recording material according to claim 1, wherein the diazo compound represented by general formula (1) is contained in a form of a complex compound.

8. The heat-sensitive recording material according to claim 1, wherein the coupler contained in the heat-sensitive recording layer is contained outside the microcapsules.

9. The heat-sensitive recording material according to claim 1, wherein a high polymer forming the capsule walls of the microcapsules has a glass transition temperature in a range from 60 to 200° C.

10. The heat-sensitive recording material according to claim 1, wherein the diazo compound represented by general formula (1) is contained in the heat-sensitive recording layer in an amount ranging from 0.02 to 5 $g/m^2$.

11. The heat-sensitive recording material according to claim 1, wherein the heat-sensitive recording layer is a laminated type recording layer comprising a plurality of layers.

12. A heat-sensitive recording material comprising a support and at least one heat-sensitive recording layer, wherein the heat-sensitive recording layer comprises at least one diazo compound and at least one coupler, and the at least one diazo compound is encapsulated in microcapsules and is represented by the following general formula (2):

General formula (2)

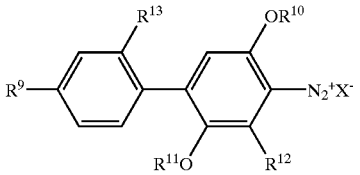

wherein $R^9$ represents a hydrogen atom, an alkyl group or an alkoxy group; $R^{10}$ and $R^{11}$ each independently represents an alkyl group; $R^{12}$ and $R^{13}$ each independently represents a hydrogen atom, a halogen, an alkyl group or an alkoxy group; and X- represents an anion.

13. The heat-sensitive recording material according to claim 12, wherein the coupler is represented by the following general formula (3):

$$E^1—CH_2—E^2$$ General formula (3)

wherein $E^1$ and $E^2$ each independently represents an electron attractive group and $E^1$ and $E^2$ may be bonded to each other to form a ring.

14. The heat-sensitive recording material according to claim 12, wherein capsule walls of the microcapsules comprise at least one of polyurethane and polyurea.

15. The heat-sensitive recording material according to claim 12, wherein the alkyl group or the alkoxy group has 1 to 12 carbon atoms.

16. The heat-sensitive recording material according to claim 12, wherein the alkyl group or the alkoxy group has a substituent.

17. The heat-sensitive recording material according to claim 12, wherein an average particle diameter of the microcapsules is 0.3 to 12 $\mu$m.

18. The heat-sensitive recording material according to claim 12, wherein the heat-sensitive recording layer further comprises at least one selected from a group consisting of an organic base, a free radical generating agent, an acid stabilizer, an antioxidant, a color-formation aid, a wax, an antistatic agent, a defoaming agent, a fluorescent dye, a surfactant and an ultraviolet ray absorbent.

19. A heat-sensitive recording method comprising the steps of:

preparing a heat-sensitive recording material comprising a support and at least one heat-sensitive recording layer, the heat-sensitive recording layer comprising at least one diazo compound and at least one coupler, the at least one diazo compound being encapsulated in microcapsules and being represented by the following general formula (1):

General formula (1)

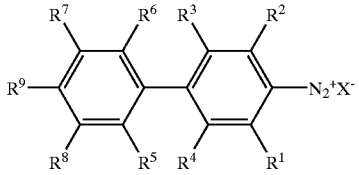

wherein $R^1$, $R^2$, $R^3$, $R^4$, $R^5$, $R^6$, $R^7$ and $R^8$ each independently represent a hydrogen atom, a halogen, an alkyl group, an alkoxy group, an alkylthio group or an arylthio group; $R^9$ represents a hydrogen atom, an alkyl group or an alkoxy group; and $X^-$ represents an anion;

heating a recording surface of the heat-sensitive recording material imagewise to cause a reaction between the diazo compound and the coupler to form a color; and irradiating light to decompose the remaining diazo compound which has not formed a color.

20. The heat-sensitive recording method according to claim 19, wherein the light has a wavelength longer than 400 nm.

* * * * *